United States Patent [19]

Schoeb et al.

[11] Patent Number: 5,016,745

[45] Date of Patent: May 21, 1991

[54] DETECTION DEVICE FOR DETECTING THAT A COIN RECEPTACLE IS FULL

[75] Inventors: Pascal Schoeb; Dominique Holtzer, both of Besancon, France

[73] Assignee: Schlumberger Industries, Montrouge, France

[21] Appl. No.: 263,153

[22] Filed: Oct. 28, 1988

[30] Foreign Application Priority Data

Nov. 9, 1987 [FR] France ..... 8715478

[51] Int. Cl.[5] ..... G07F 9/06

[52] U.S. Cl. ..... 194/346; 194/350; 453/17

[58] Field of Search ..... 194/241, 242, 240, 246, 194/346, 200, 202, 203; 453/16, 17; 221/14, 17; 379/147, 150, 155

[56] References Cited

U.S. PATENT DOCUMENTS

| | | | |
|---|---|---|---|
| 2,502,999 | 4/1950 | Shann | 379/155 |
| 2,642,881 | 6/1953 | Buchholz | 453/17 |
| 3,091,663 | 5/1963 | Stokes | 379/147 |
| 3,106,924 | 10/1963 | Peacock et al. | 453/16 |
| 3,204,648 | 9/1965 | Rumer et al. | 453/16 |
| 3,260,338 | 7/1966 | Labarge | 379/150 |
| 3,726,378 | 4/1973 | Simons | 453/16 X |

FOREIGN PATENT DOCUMENTS

| | | | |
|---|---|---|---|
| 0116215 | 8/1984 | European Pat. Off. | 453/17 |
| 2709954 | 9/1978 | Fed. Rep. of Germany | 453/17 |
| 2818694 | 8/1979 | Fed. Rep. of Germany | 453/17 |

*Primary Examiner*—F. J. Bartuska

*Attorney, Agent, or Firm*—Frishauf, Holtz, Goodman & Woodward

[57] ABSTRACT

The invention relates to a detection device for detecting that the coin storage receptacle of a slot machine such as a parking meter is full of coins. The device includes a moving flap (32) disposed across the coin arrival path. A microswitch (42) detects the position of the flap (32). If the flap does not return to its rest position, then the receptcle is full.

16 Claims, 3 Drawing Sheets

DETECTION DEVICE FOR DETECTING THAT A COIN RECEPTACLE IS FULL

The present invention relates to a device for detecting that a receptacle has been filled with coins, tokens, or the like.

BACKGROUND OF THE INVENTION

Numerous machines are actuated by coins, or tokens, or the like and they contain a coin receptacle for storing said coins, ect. Examples of such "slot machines" include pay phones, vending machines, and meters for paying for car parking In such machines, coins are inserted via one or more slots and they pass through a coin selector of varying degrees of complexity which verifies that the coins are not counterfeit and which also establishes the value of the coins. Reject coins are returned to the user while accepted coins are sent via a chute to a coin receptacle. In some cases, the chute may include a coin hold device which temporarily retains accepted coins until the user actuates a coin-encashing control which allows the coins to go to the coin receptacle. Until the user actuates the coin-encashing control, the user retains the possibility of abandoning the operation and recovering the coins.

The organization in charge of the machines must periodically collect the coins contained in the receptacle. In some cases the receptacle is fixed in the machine and collection takes place by opening a trap door communicating with the receptacle. In other cases the receptacle is in the form of a removable safe. Collection then consists in removing full receptacles and replacing them with empty receptacles. European patent number 44 754 in the name of FLONIC describes a parking fee terminal equipped with the first type of coin receptacle.

One of the problems with managing such machines is defining when to collect coins from them. If collections are performed too frequently relative to the real capacity of each receptacle, then operating expenses are too high. In contrast, if collections are not performed frequently enough, then the receptacles are in danger of overflowing. Overflowing is always bad, since it either causes coins to be lost or else it disturbs the overall operation of the coin circuit in the machine. If the receptacle is removable, coin overflow may jam the receptacle and prevent it from being removed. If the receptacle if fixed, coin overflow can fill up the coin arrival chute and hinder operation of systems disposed upstream from the chute. It is therefore always desirable to provide a device in such a machine for detecting that its coin receptacle is full.

One possible detection system consists in taking advantage of the fact that an electronic coin selector can also be used to count all the coins it has selected. However this solution is not satisfactory since coins come in different sizes and the way in which they pile up in the receptacle is random. In order to perform detection by counting coins, it is therefore necessary to provide a considerable safety margin over optimum filling.

In order to remedy these drawbacks, an object of the invention is to provide a device for detecting that a coin receptacle is full by detecting the level to which a receptacle is actually filled regardless of the nature of the coins it contains.

SUMMARY OF THE INVENTION

According to the invention, this object is achieved by a detection device for detecting that a coin storage receptacle is full, the device comprising: a moving member disposed in the coin inlet passage to the receptacle, said moving member having a rest position when coins are not passing, and moving away from said rest position in order to allow coins to pass towards said receptacle; and monitoring means for monitoring that said moving member is indeed in its rest position when coins are not passing.

It can thus readily be understood that a full receptacle is reliably detected since it is only when the receptacle is already full that coins which cannot get into the receptacle will prevent the moving element from returning to its rest position.

In a first embodiment of the invention including return means, said moving member is a tilting flap disposed across the inlet opening for allowing coins into said receptacle, with said flap being normally returned, when at rest, by said return means to its position in which it closes said opening, said return means being rated so that the weight of any coin is sufficient to move said flap away from its rest position, and the monitoring means include means for detecting the position of said flap.

In a second embodiment of the invention, said receptacle is associated with a coin hold device, said coin hold device including a moving flap, an external system for causing said flap to open by moving said flap to a position in which it allows coins to pass, and a return system for returning said flap to a closed position in which it prevents coins from passing to said receptacle, said monitoring device including means for detecting the return of said moving flaps to its closed position.

BRIEF DESCRIPTION OF THE DRAWINGS

Embodiments of the invention are described by way of example with reference to the accompanying drawings, in which.

MORE DETAILED DESCRIPTION

Figure 1:
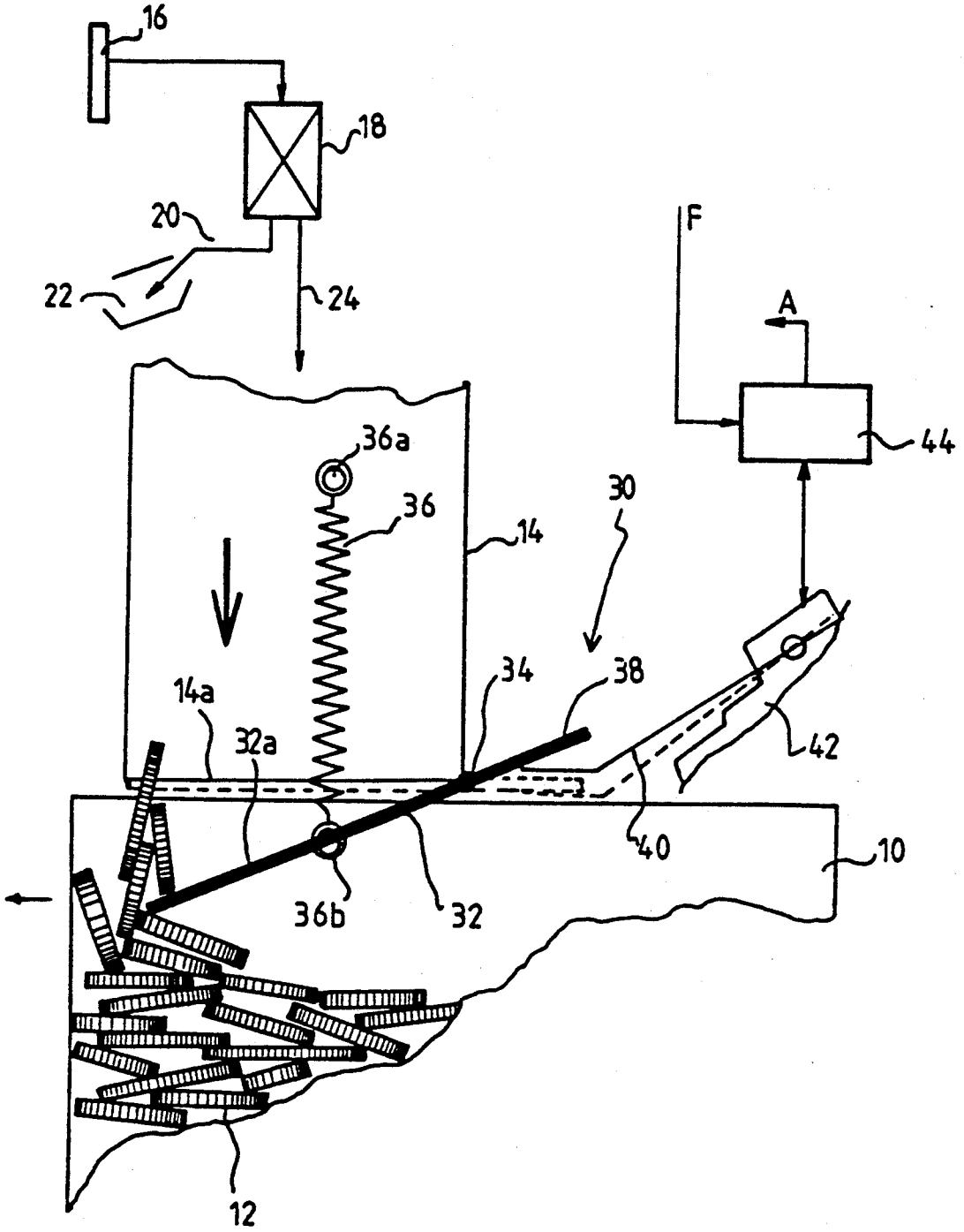
FIG. 1 is a vertical section through a first embodiment of a device for detecting that a coin receptacle is full.

Reference is made initially to FIG. 1 for describing a first embodiment of a device in accordance with the invention for detecting that a coin receptacle is full.

FIG. 1 shows a storage receptacle 10 for receiving coins 12. The receptacle 10 is removed from the machine in order to collect the coins. The receptacle 10 is disposed beneath a coin-guiding chute 14. Coins are inserted into the machine via a slot 16 and they pass through a coin selector 18 which serves to verify that inserted coins are not counterfeit and also to determine the value of the coins. Inserted coins which are counterfeit or which do not correspond to acceptable coin values are directed by the selector 18 via a channel 20 to a coin return slot 22. Otherwise, accepted coins are directed towards the chute 14 via a channel 24. Accepted coins are thus directed to the coin receptacle 10.

A device 30 for monitoring the filling of the receptacle 10 comprises a flap 32 pivotally mounted about an axis 34 which is fixed to the bottom end of the chute 14. The flap 32 is associated with a return spring 36. One end 36*a* of the spring 36 is fixed, e.g. to the chute 14, while the opposite end 36*b* of the spring is a moving end since it is fixed to the flap 32. While there are no coins passing, the flap 32 closes the bottom end 14*a* of the chute 14 under the action of the return spring 36. In FIG. 1, the flap 32 is shown in this closed position by means of dashed lines. The flap 32 includes an extension 38 projecting beyond its pivot axis 34. The extension 38 co-operates with the moving arm 40 of a microswitch 42. Whenever the flap 32 moves away from its rest position, i.e. whenever it is not closing the chute 14, the microswitch 42 is open.

A processing circuit 44 monitors the position of the microswitch 42 in manners described below.

The detection device operates as follows. So long as no coins are passing along the chute 14, the flap is in its rest position closing the chute and the microswitch 42 is closed. When a coin enters the chute 14 it strikes the top face 32*a* of the flap 32. The spring 36 is rated so that it opens, at least under normal operating conditions, under the impact of a coin lighter than the lightest acceptable coin. Coins slide off the face 32*a* and fall into the receptacle 10. Throughout the time that the flap is in its open position, the microswitch 42 is also open. The processing circuit 44 receives a signal F when the coin insertion stage is over. The signal F may be delivered when the user validates prior coin insertion. The circuit 44 includes a timing circuit of duration T, which duration is chosen to be substantially greater than the time which normally elapses between an operation being validated by the user and the coins being properly received in the coin receptacle. When a time T has elapsed after the appearance of the signal F, the circuit 44 tests the position of the arm 40 of the microswitch 42. If the microswitch is open, then the circuit emits an alarm signal A. Otherwise no signal is emitted since operation is normal.

If the receptacle 10 is already full when a coin arrives in the chute 14, the flap 32 moves downwards but the coin present on its top face 32*a* cannot fall into the receptacle 12. It remains on the flap and holds it open. The microswitch 42 remains open after time T and the circuit 44 delivers an alarm signal A indicating that the receptacle 10 is full. The signal A may trigger an indicator lamp disposed on the face of the machine to indicate that the receptacle should be emptied. The signal A may also prevent operation of the machine, for example by closing the coin slot 16. It can be seen that the detector does indeed monitor that the receptacle is full regardless of the various random parameters which may have an effect on the filling of the receptacle 10, and in particular regardless of the various different sizes of coin and their friction coefficients which determine how the coins pile up inside the receptacle.

Figure 2:
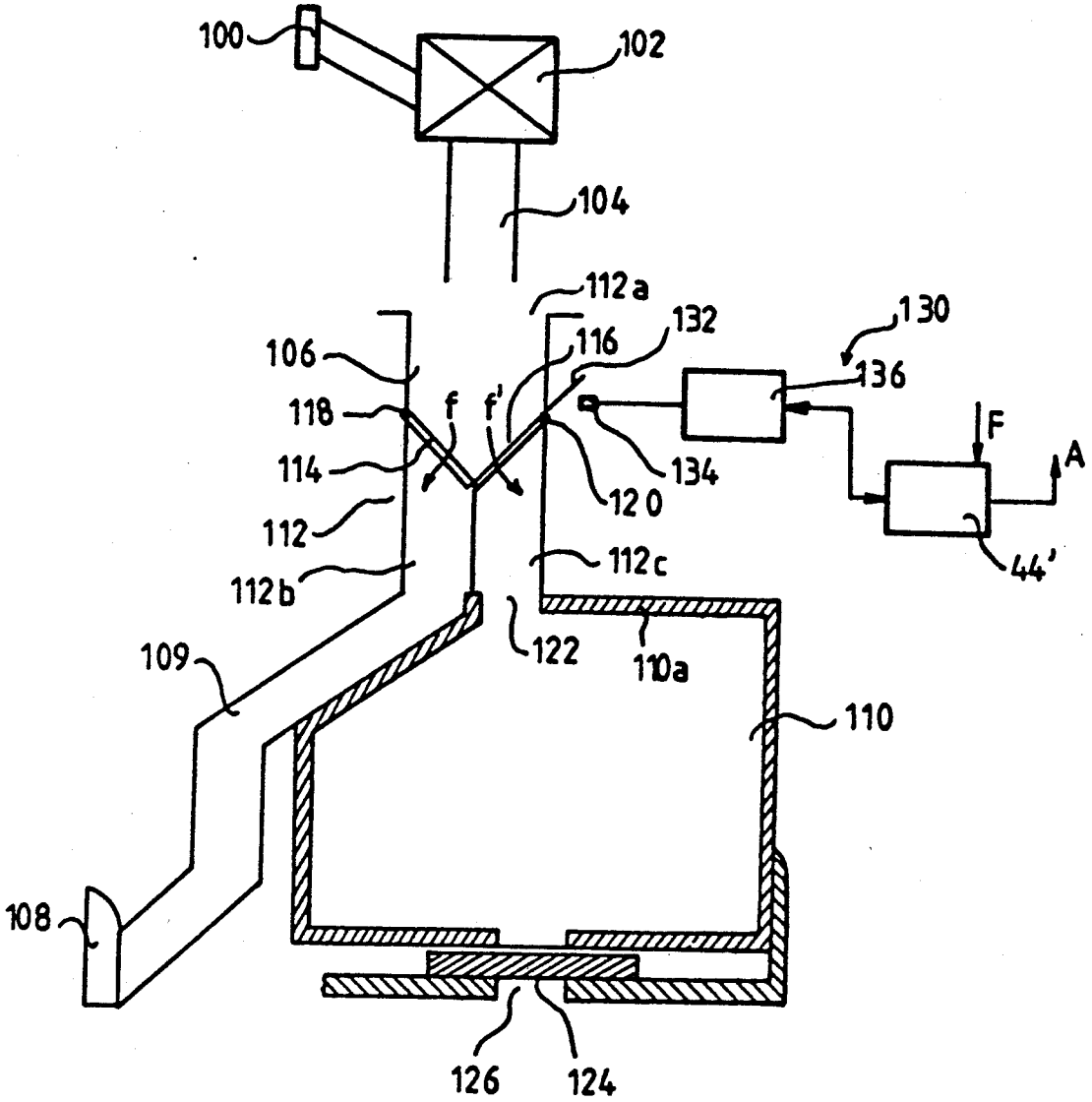
FIG. 2 is a simplified overall view of a slot machine fitted with a device for detecting that a coin receptacle is full.

FIG. 2 shows a second embodiment of the invention in which the machine includes a coin hold system and the coin storage receptacle is integral with the machine. The machine includes one or more coin slots associated with a coin selector 102. The coin selector 102 communicates with a chute 104 which conveys the coins to a coin hold device 106. The coin hold device serves to temporarily retain the coins inserted via the coin slot 100 and to direct them either to a coin return slot 108 via channel 109, or else to a storage receptacle 110.

The coin hold device 106 includes a housing 112 which is open at both ends, with its top end 112*a* communicating with the chute 104. The housing 112 has two flaps 114 and 116 which are pivotally mounted about two parallel axes 118 and 120. At rest, as shown in FIG. 2, the two flaps 114 and 116 are inclined in such a manner as to completely close the outlet passage from the housing 112. The bottom end of the housing 112 defines two passages respectively referenced 112*b* and 112*c*. The passage 112*b* is disposed beneath the "return" flap 114 and communicates with the channel 109 which is in turn connected to the coin return slot 108, while the passage 112 is disposed beneath the encashing flap 116 and communicates directly with an opening 122 provided in the top wall 110*a* of the receptacle 110. The flap 114 may be controlled by an actuator (not shown) in order to take up a vertical position as shown in FIG. 2 by arrow f. The actuator causes this movement to occur either if the user of the machine abandons obtaining the service provided by the machine and desires to recover the coins already inserted into the slot 100, or else if the machine decides to open the flap. The other flap 116 may also be controlled by an actuator to take up a vertical position as indicated by arrow f'. The flap 116 is displaced each time the user of the machine confirms that a service delivered by the machine is indeed desired. Since the receptacle 110 is fixed, coins may be collected by operating a slide 124 which normally closes an orifice 126.

The device 130 for detecting that the receptacle is full is very similar to that shown in FIG. 1. The flap 116 is extended beyond its axis 120 by a finger 132 which is fixed to the flap 116. The finger 132 may co-operate with the moving arm 134 of a microswitch 136. When the flap 116 is at rest (as shown in FIG. 2), the microswitch 136 does deliver a signal. When the flap is no longer in its rest position, its finger 132 acts on the moving arm 132 of the microswitch 136 and the microswitch remains open. This open position of the microswitch is detected by a processing circuit 44' which is identical to the circuit 44 of FIG. 1.

The detection device operates as follows. When coins are to be inserted into the receptacle 110, the actuator causes the flap 116 to pivot for a predetermined length of time T1 in order to allow the coins to fall into the receptacle 110. The above-defined T is naturally greater than T1. During this period of time, the microswitch 136 remains opens. The circuit 44'tests the position of the microswitch at the end of time T. So long as the receptacle 110 is not full, the flap 116 will indeed return to its rest position at the end of time T1 which is less than T. Otherwise, if the receptacle 110 is already full of coins, after the flap 116 has pivoted, some coins will remain inside the housing 112 in a position which will prevent the flap 116 from returning to its rest position at the end of time T1. The circuit 44' detects that the microswitch 136 is still open at the end of time T. The circuit 44' then emits an alarm signal A'. In turn, the alarm signal A' may cause an indicator light to be switched on indicating that the receptacle 110 is full and may also cause the machine to be taken out of service.

Figure 3:
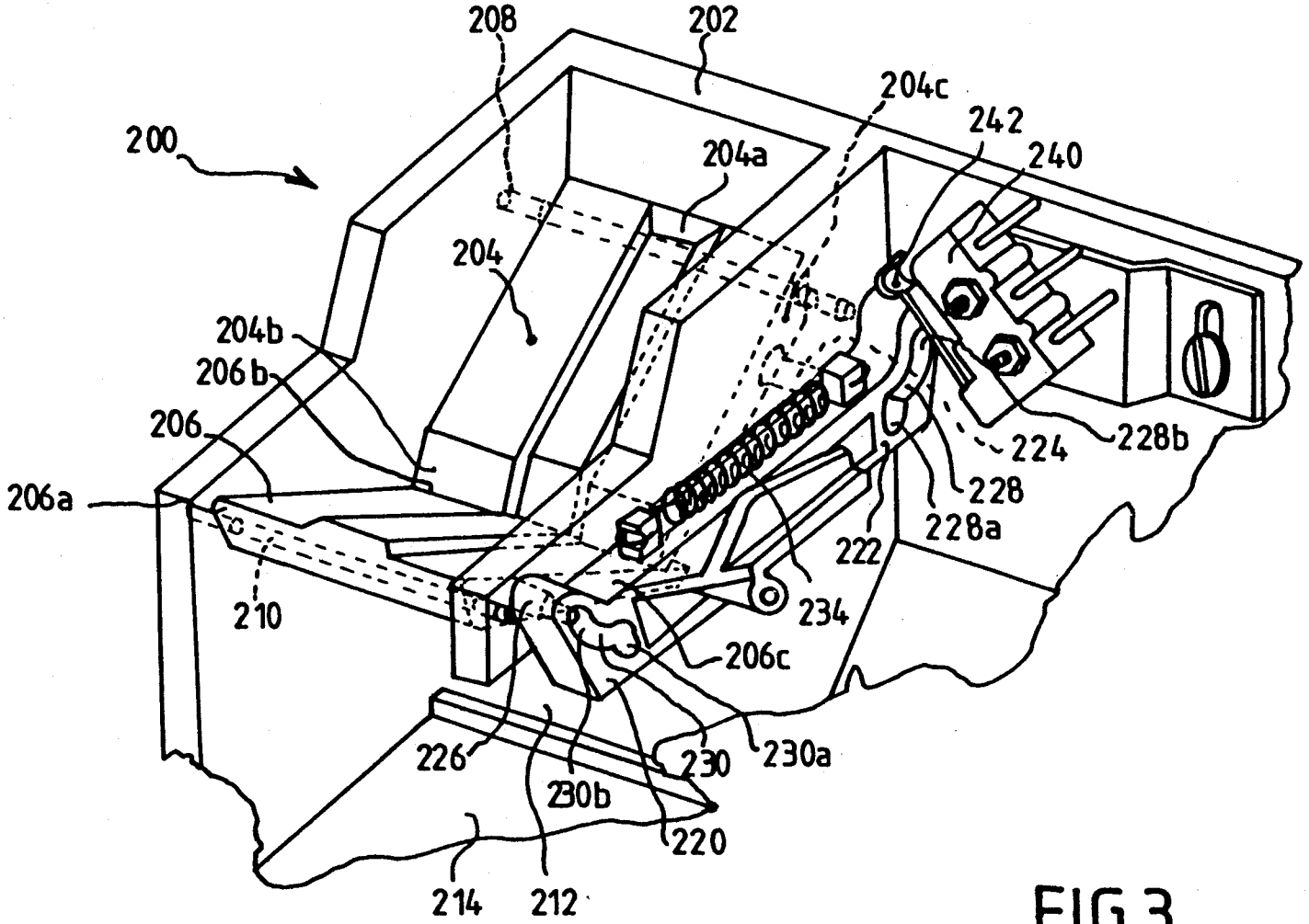
FIG. 3 is a perspective view showing a detail of the detection device fitted to the FIG. 2 machine.

Reference is now made to FIG. 3 for describing a particular implementation of the FIG. 2 embodiment in greater detail, i.e. an implementation in which the coin storage receptacle has a coin hold device disposed above it.

The coin hold device 200 comprises a housing 202 which is open at its top and bottom ends. Two flaps 204 and 206 are pivotally mounted about respective axes 208 and 210 inside the passage delimited by the housing 202, with said axes being located at respective first ends 204*a* and 206*a* of the two flaps. The lengths of the flaps are such that when the second ends 204*b* and 206*b* of the flaps come into contact (in the rest position), the flaps are inclined relative to the horizontal. In this position, the flaps 204 and 206 completely close the passage delimited by the housing 202. The flap 204 is disposed above the zone 212 which includes the orifice of the coin storage receptacle, whereas the flap 206 lies over the coin return chute 214. The flaps 204 and 206 are controlled via respective cams 220 and 222 which co-operate with respective lugs 224 and 226 mounted on the side 204*c* and 206*c* of the flaps 204 and 206 and passing through the wall of the housing 202.

More precisely, the cams 222 and 220 include respective slots 228 and 230 constituting camming surfaces for the corresponding lugs 224 and 226. Each slot includes a respective locking zone 228*a* and 230*a* and a half-moon shaped opening zone respectively referenced 228*b* and 230*b*, with the cams 220 and 222 being controlled by rotation of a shaft (not shown). Depending on the direction in which the shaft is rotated, either the cam 220 or the cam 222 is rotated. At rest, each of the lugs 224 and 226 is engaged in the corresponding locking zone 228*a* or 230*a* of its camming surface. When the encashment flap 204 is to be opened, the cam 222 is pivoted. This pivoting acts by means of the lug 224 which now penetrates into the zone 228*b* of the slot 228 to cause the flap 204 to pivot in turn. When the drive to the pivot-controlling shaft ceases, a return spring 234 returns the cam 220, and thus the flap 204, to the rest position shown in FIG. 3. The coin return flap 206 is opened in similar manner but by causing the control shaft to rotate in the opposite direction.

In order to detect when the coin storage receptacle is full, the return of the encashment flap 204 to its rest position is monitored. To do this, a microswitch 240 is mounted on the housing 202. The flexible arm 242 of the microswitch 240 co-operates with one end of the cam 222. When the flap 204 is open or partially opened, the arm 242 is not in contact with the cam 222 and the microswitch is open. It is only when the flap 204 is in its rest position that the cam 222 is in contact with the flexible arm 242 which closes the microswitch 240.

As already explained, when the instruction to open the flap 204 is released, the flap 204 ought normally to return to its rest position under the effect of the return spring 234 I.e., under normal circumstances, after the encashment flap 204 has been opened, the microswitch 240 should open. In contrast, if the storage receptacle is full, as explained above, the flap 204 can no longer return fully to its rest position and so the microswitch 240 remains open. This situation is detected and allows an alarm to be triggered or the other operations to be performed as already described with reference to FIGS. 1 and 2.

It follows from the above description that the invention makes it possible to monitor the actual filling of a coin receptacle using a detection system which is very simple, in other words the monitoring of the coin receptacle takes into account the various different sizes of coins and the random ways in which they can pile up in a coin storage receptacle.

We claim:

1. A device for detecting that a coin storage receptacle is full of stored coins, said stored coins having different sizes and being piled up in said receptacle in a random way, said device comprising:

a coin receptacle with an opening in its top;

a coin inlet passage having a bottom end which opens toward the receptacle opening to direct coins into the receptacle;

a movable member having a rest position blocking passage of coins from the coin inlet passage into the receptacle and a displaced position permitting passage of coins from the coin inlet passage into the receptacle;

return means coupled to the movable member for, after the movable member has been away from its rest position toward its displaced position, returning said movable member to its rest position, said return means being incapable of returning the movable member to its rest position against the weight of a coin lying on the movable member; and monitoring means for generating a signal when it detects a condition of, with no coin passing through said coin inlet passage, the movable member being away from its rest position, whereby said signal is indicative of the receptacle being full.

2. The detection device of claim 1, wherein the monitoring means generates said receptacle full signal only after a predetermined time interval lapses from passage of a last coin through the coin inlet passage.

3. The detection device of claim 2, wherein the predetermined time interval is sufficient to have a coin complete its travel past the movable member into the receptacle, and for the movable member to return to its rest position.

4. The detection device of claim 3, wherein the movable member is rotatable about a pivot point.

5. The detection device of claim 4, wherein the movable member closes the bottom end of said receptacle in its rest position.

6. The detection device of claim 5, wherein the movable member extends into said receptacle in its displaced position.

7. The detection device of claim 6, wherein said return means is a spring.

8. The detection device of claim 7, wherein the movable member is moved from its rest position to its displaced position only by the weight of coins dropping on it through the coin inlet passage and acting against the opposing force applied to the movable member by said return means.

9. The detection device of claim 7, wherein the movable member is moved from its rest position to its displaced position by an actuator, and means for controlling said actuator to operate in response to the coin being such as to be returned or retained.

10. The detection device of claim 1, wherein said monitoring means comprises a sensor means to detect the presence of the movable member at said rest position, and a timer means for generating a time interval that is started by a coin passing through the coin inlet passage and directed into the receptacle and having a duration sufficient for the arrival of the coin in the receptacle and return of the movable member to its rest position, and means responsive to lapse of the time interval when the movable member is still away from its rest positon to generate said full receptacle signal.

11. The detection device of claim 10, wherein the movable member is rotatable about a pivot point with one portion thereof on one side of the pivot point being movable between said rest and displaced positions, and another portion thereof extending away from said one portion on another side of said pivot point being operatively associated with said sensor means.

12. The detection device of claim 1, wherein the movable member is moved from its rest position to its displaced position only by the weight of coins dropping on it through the coin inlet passage and acting against the opposing force applied to the movable member by said return means.

13. The detection device of claim 1, wherein the movable member is moved from its rest position to its displaced position by an actuator, and means for controlling said actuator to operate in response to the coin being such as to be returned or retained.

14. The detection device of claim 1, wherein the movable member is rotatable about a pivot point.

15. The detection device of claim 1, wherein the movable member closes the bottom end of said receptacle in its rest position.

16. The detection device of claim 1, wherein said return means is a spring.

* * * * *